US010382874B2

(12) United States Patent
Fuller

(10) Patent No.: US 10,382,874 B2
(45) Date of Patent: Aug. 13, 2019

(54) MAGNETIC ASSEMBLY FOR SPEAKER DEVICE

(71) Applicant: Jacob Aaron Fuller, Troutman, NC (US)

(72) Inventor: Jacob Aaron Fuller, Troutman, NC (US)

( * ) Notice: Subject to any disclaimer, the term of this patent is extended or adjusted under 35 U.S.C. 154(b) by 0 days.

(21) Appl. No.: 15/158,074

(22) Filed: May 18, 2016

(65) Prior Publication Data

US 2017/0339501 A1 Nov. 23, 2017

(51) Int. Cl.
*H04R 31/00* (2006.01)
*H04R 9/02* (2006.01)

(52) U.S. Cl.
CPC ..... *H04R 31/006* (2013.01); *H04R 9/025* (2013.01)

(58) Field of Classification Search
CPC ..... H04R 31/006; H04R 9/025; H04R 9/027; H04R 9/04; H04R 9/022; H04R 9/02; H04R 9/06; H04R 7/20; H04R 31/003; H04R 7/045; G08B 7/06; G03B 15/05
See application file for complete search history.

(56) References Cited

U.S. PATENT DOCUMENTS 5,748,760 A * 5/1998 Button ..... H04R 9/022 381/400
5,909,015 A * 6/1999 Yamamoto ..... H04R 9/022 181/156
6,675,931 B2 * 1/2004 Sahyoun ..... H04R 7/20 181/144
8,059,190 B2 * 11/2011 Chang ..... G03B 15/05 348/371
8,948,441 B2 * 2/2015 Zhao ..... H04R 7/045 381/398
2004/0086150 A1 * 5/2004 Stiles ..... H04R 9/025 381/421
2005/0041831 A1 * 2/2005 Stiles ..... H04R 9/022 381/412
2005/0190945 A1 * 9/2005 Calderwood ..... H04R 9/025 381/412
2005/0190946 A1 * 9/2005 Stiles ..... H04R 9/025 381/421
2011/0102666 A1 * 5/2011 Neufeglise ..... G08B 7/06 348/373
2013/0163806 A1 * 6/2013 North ..... H04R 9/025 381/396
2013/0266173 A1 * 10/2013 Niedermann ..... H04R 9/02 381/400
2017/0332174 A1 * 11/2017 Lee ..... H04R 9/06

* cited by examiner

*Primary Examiner* — Fan S Tsang
*Assistant Examiner* — Angelica M McKinney
(74) *Attorney, Agent, or Firm* — Seth L. Hudson; Clements Bernard Walker PLLC

(57) ABSTRACT

The present invention provides methods and systems for a motor assembly that includes a pole piece, at least one magnet, a first magnetizing ring, and an air gap between the pole piece and the first magnetizing ring.

19 Claims, 11 Drawing Sheets

MAGNETIC ASSEMBLY FOR SPEAKER DEVICE

FIELD OF THE INVENTION

The present invention relates generally to a magnet assembly for a speaker device, and more generally relates to a magnetic assembly with at least an inner ring that conducts magnetism and is a consistent distance from the pole of a speaker device for generating enhanced sound.

BACKGROUND OF THE INVENTION

Audio speakers are well known and widely used for transmitting audio sound. Audio speakers use electrical signals to produce air pressure waves which are perceived as sounds. Audio speakers may use a diaphragm that is movably suspended in a frame. The diaphragm is coupled to a voice coil that is suspended in a magnetic field. The electrical signals representing the sound flow through the voice coil and interact with the magnetic field. This causes the voice coil and the coupled diaphragm to oscillate in response to the electrical signal. The oscillation of the diaphragm produces air pressure waves.

It is desirable for an audio speaker that has magnets that are positioned a constant distance from the pole and contains at least an inner ring that conducts magnetism from the magnets for producing enhanced sound.

BRIEF SUMMARY OF THE INVENTION

According to an embodiment of the present invention, a motor assembly includes a pole piece, at least one magnet, a first magnetizing ring, and an air gap disposed between the pole piece and the first magnetizing ring.

According to yet another embodiment of the present invention, the motor assembly includes a pole piece that is generally circular and at least one magnet has a first side and a second side, whereby at least the first side has a radius of curvature the same as a radius of curvature of the pole piece According to yet another embodiment of the present invention, the motor assembly includes a shelf positioned under the at least one magnet further comprising a channel for receiving the at least one magnet.

According to yet another embodiment of the present invention, the motor assembly includes a second magnetizing ring adjacent the at least one magnet.

According to yet another embodiment of the present invention, the motor assembly includes a top plate with a top side and a bottom side, wherein the bottom side includes a channel for receiving the at least one magnet.

According to yet another embodiment of the present invention, the motor assembly includes a housing that houses the motor assembly and contains at least one vent hole in a side of the housing.

According to yet another embodiment of the present invention, the motor assembly includes a neo-magnet.

According to yet another embodiment of the present invention, the motor assembly includes a diaphragm assembly.

According to yet another embodiment of the present invention, the motor assembly includes a pole piece, a plurality of magnets spaced-apart from each other, a first magnetizing ring, and an air gap between the pole piece and the first magnetizing ring.

According to yet another embodiment of the present invention, the motor assembly includes a plurality of magnets spaced an equal distance apart from each other around the periphery of the pole piece.

According to yet another embodiment of the present invention, the motor assembly includes a second magnetizing ring.

According to yet another embodiment of the present invention, the motor assembly includes a voice coil and bobbin that partially encircles the pole piece.

According to yet another embodiment of the present invention, the motor assembly wherein the first magnetizing ring is composed of aluminum.

According to yet another embodiment of the present invention, the motor assembly includes a diaphragm assembly, a pole piece, a plurality of magnets spaced-apart from each other, a first magnetizing ring, and an air gap disposed between the pole piece and the first magnetizing ring.

According to yet another embodiment of the present invention, the motor assembly wherein the plurality of magnets are positioned between the first magnetizing ring and the second magnetizing ring.

According to yet another embodiment of the present invention, the motor assembly includes a housing that houses the pole piece, the plurality of magnets, the first magnetizing ring, and the air gap, wherein the housing contains a lip for retaining the plurality of magnets within the housing.

According to yet another embodiment of the present invention, the motor assembly includes at least one magnet has a first side and a second side, whereby at least the first side has a radius of curvature the same as a radius of curvature of the pole piece.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
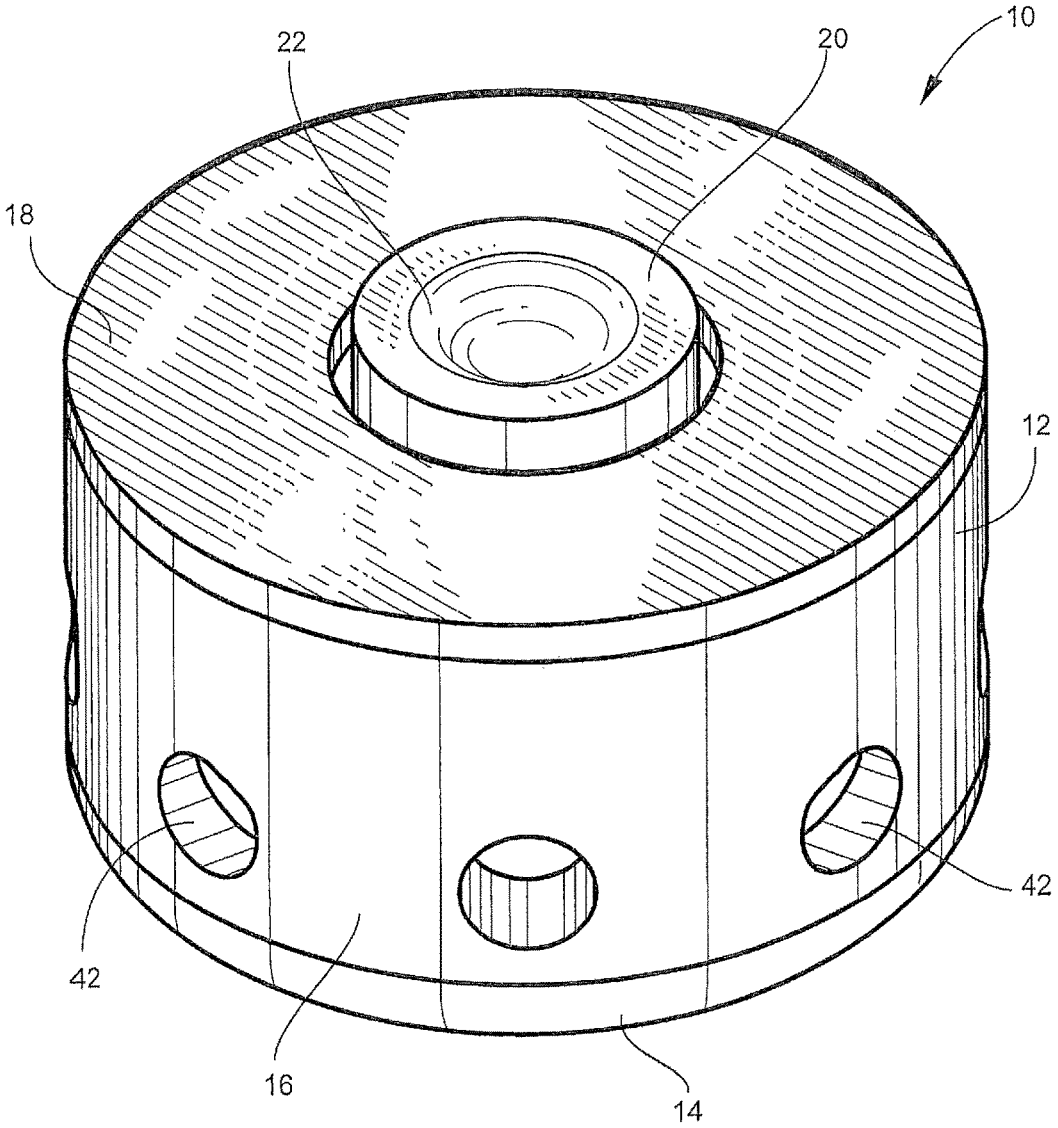
FIG. 1 is a perspective view of a motor assembly of the present invention.
Figure 2:
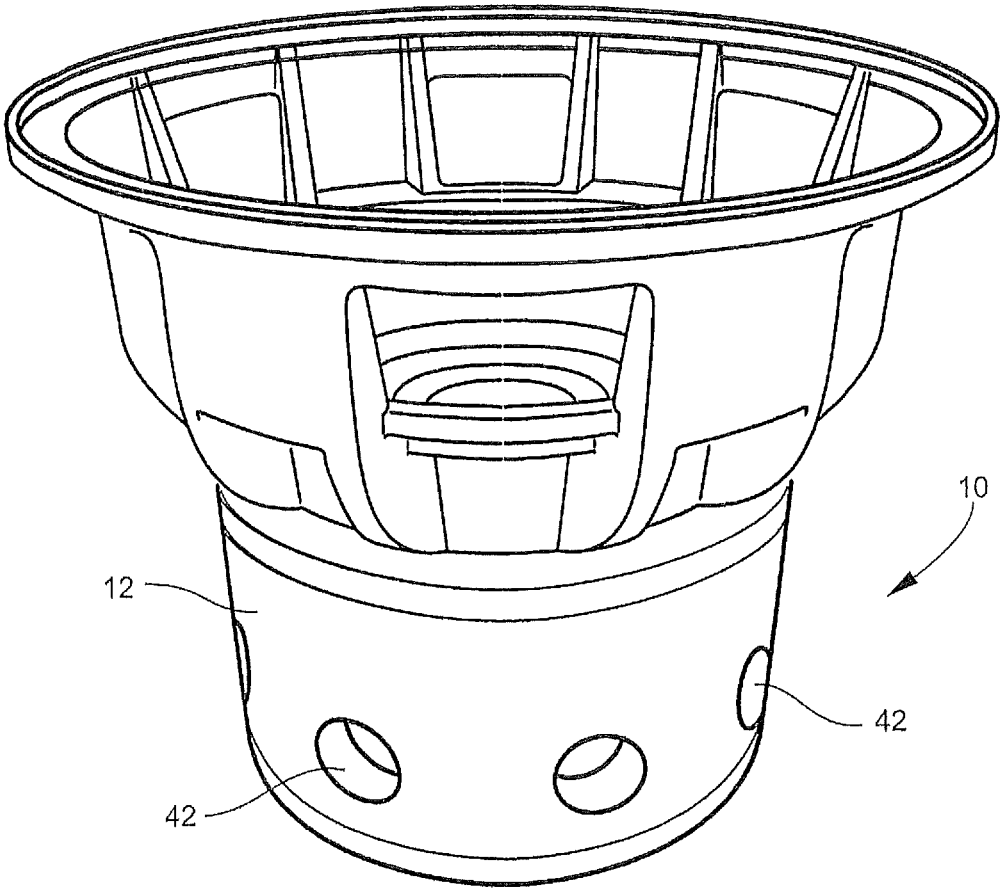
FIG. 2 is a perspective view of a motor assembly engaged to a speaker frame.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring now specifically to the drawings, a motor assembly is illustrated in FIGS. 1-11 and is shown generally at reference numeral 10. The motor assembly 10 is housed within a housing 12 that comprises a bottom portion 14 that extends to an outer edge. A side portion 16 extends generally upward from the outer edge to an upper edge. A top portion 18 is positioned on the upper edge of the side portion 16. The housing 12 can consist of three separate portions consisting of the bottom portion, 14 the side portion 16, and the top portion 18, which are engaged to each other by an attachment device 29, such as a bolt, screw, or the like. On the other hand, the housing 12 may be an integral unit. The bottom portion 14 contains a dimple 21.

The bottom portion 14, the side portion 16, and the top portion 18 each contain an exterior side and an interior side. A pole piece 20 extends upward from the interior portion of the bottom portion 14. The pole piece 20 is generally circular and has a first end and a second end. The pole piece 20 is centrally located within the housing 12. The first end is engaged to the interior portion of the bottom portion 14, and the second end contains a notch 22.

The interior side of the side portion 16 of the housing 12 contains a shelf 24 extending generally outwardly therefrom. The shelf 24 contains a first end and a second end and a top side and a bottom side, wherein the first end extends from the interior side of the side portion 16 of the housing 12. An air gap 26 is located between the pole piece 20 and the second end of the shelf 24. The shelf 24 extends circularly around the pole piece 20, while being separated from the pole piece 20 by the air gap 26. Alternatively, the shelf 24 may be placed at strategic locations along the interior side of the side portion 16.

Figure 3:
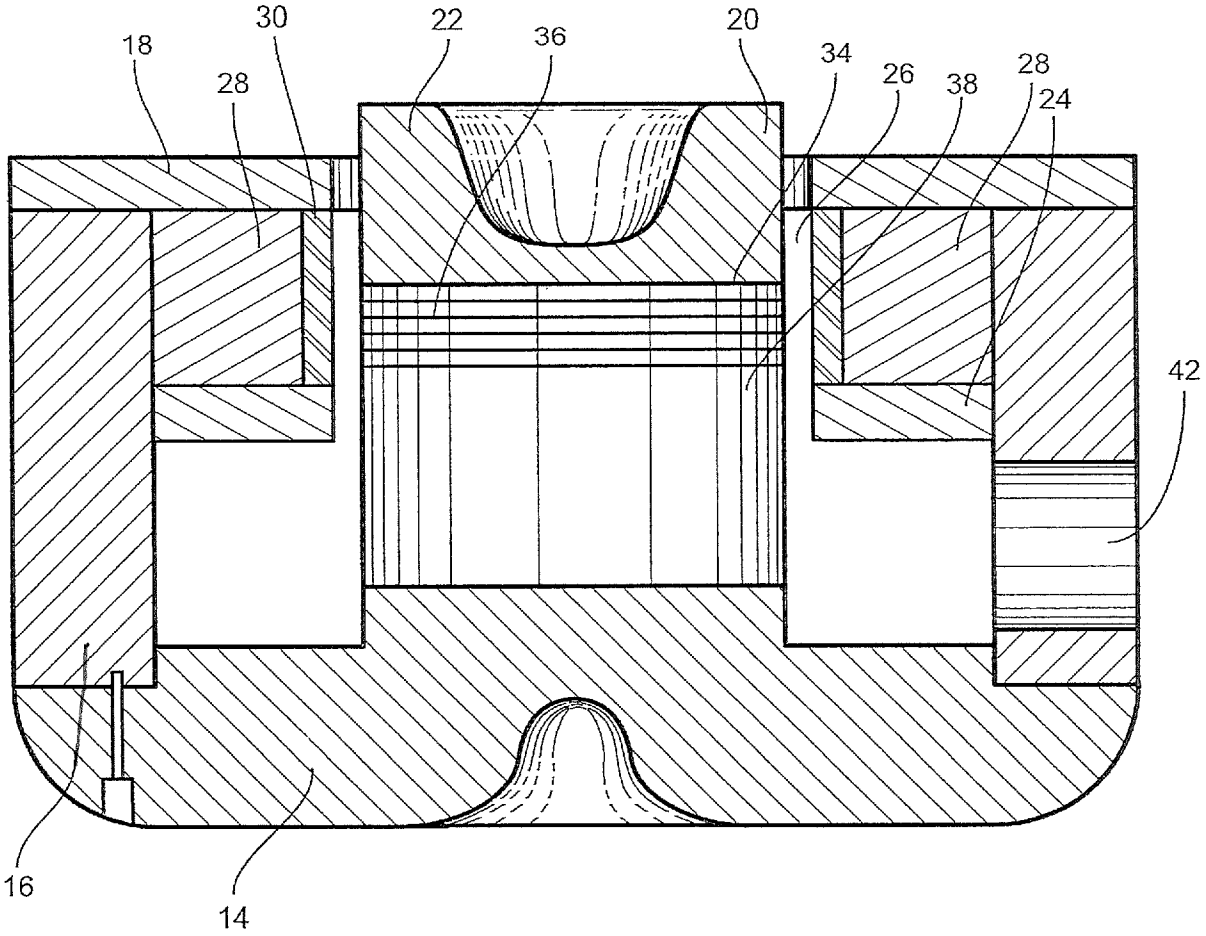
FIG. 3 is a cut-away side view of one embodiment of the present invention.
Figure 4:
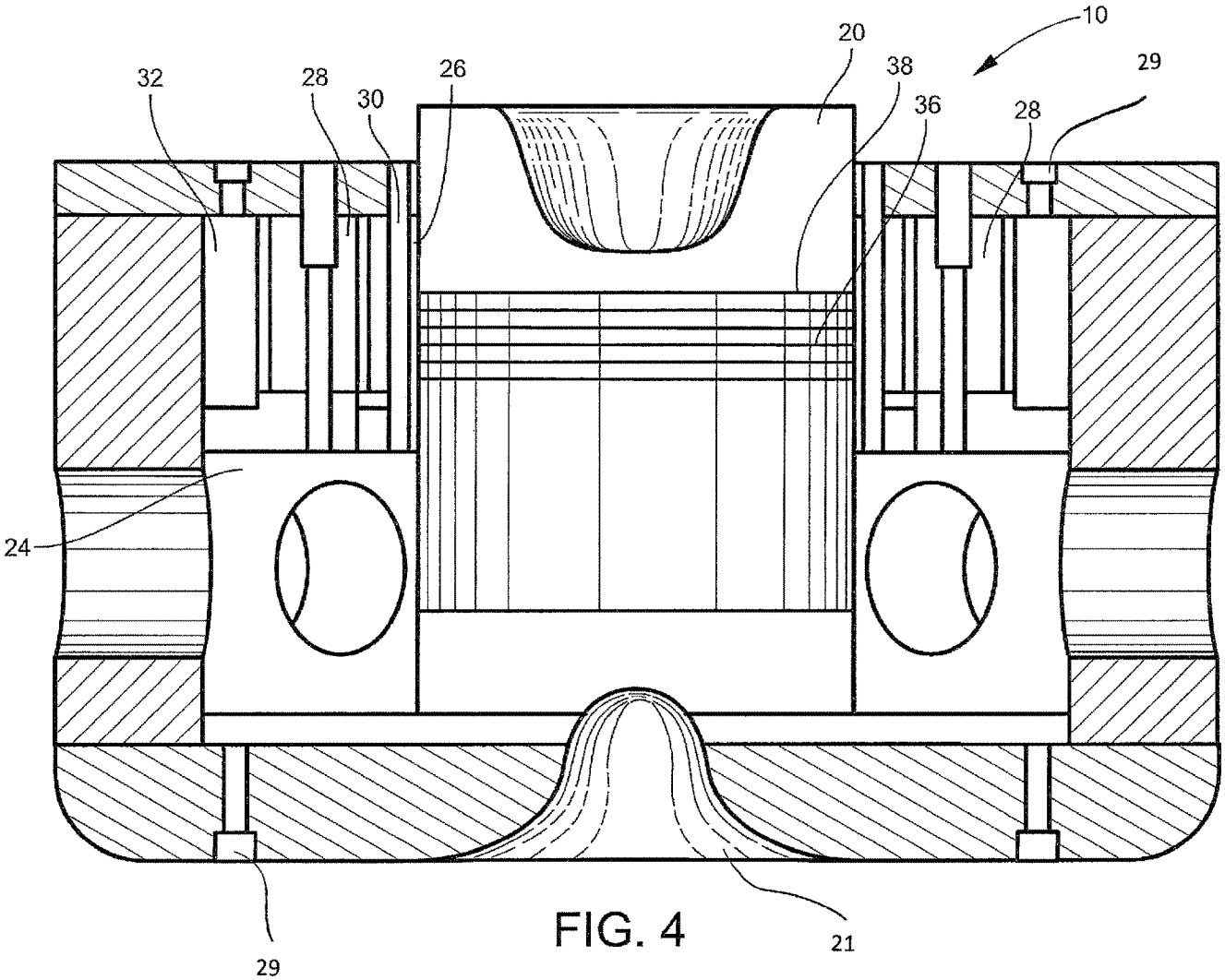
FIG. 4 is a cut-away side view of another embodiment of the present invention.

At least one magnet 28 is disposed on the top side of the shelf 24. As illustrated in FIGS. 3 and 4, a plurality of magnets 28 are placed on the shelf 24 and around the pole piece 20. The magnets 28 are spaced-apart along the shelf 24 and around the pole piece 20. In another alternative embodiment, the magnets 28 may be aligned end-to-end on the shelf 24 and around the pole piece 20 without a space between the magnets 28. In another alternative embodiment, the magnets 28 are spaced-apart an equal distance apart along the shelf 24. The space between the magnets 28 and the pole piece 20 are consistent around the pole piece 20. The shelf 24 may be composed of Aluminum or steel.

A first magnetizing ring 30 is positioned on the shelf 24 and adjacent the magnet 28 and has an interior surface, an exterior surface, and two opposed sides. As illustrated, the first magnetizing ring 30 is positioned on an edge of the second end of the shelf 24. The exterior surface of the first magnetizing ring 30 faces the air gap 26 and the interior surface is adjacent the magnet 28. The first magnetizing ring 30 encircles the pole piece 20 and is spaced-apart from the pole piece 20 with the air gap 26 therebetween. The first magnetizing ring 30 is generally circular and surrounds the pole piece 20. The first magnetizing ring 30 is composed of steel. The first magnetizing ring 30 conducts the magnetism from the magnets 28 placed behind creating a generally uniform magnetic field around the pole piece 20.

An optional second magnetizing ring 32 may be placed adjacent the backside of the magnet 28. The second magnetizing ring 32 has an interior surface and an exterior surface with two opposed ends. The second magnetizing ring 32 is placed opposite the first magnetizing ring 30 and the two magnetizing rings (30,32) sandwich the magnet 28. The interior surface of the second magnetizing ring 32 is adjacent the backside of the magnet 28, and the exterior surface of the second magnetizing ring 32 is adjacent the interior side of the side portion 16. Like the first magnetizing ring 30 and magnet 28, the second magnetizing ring 32 is placed on the top side of the shelf 24. Preferably, the second magnetizing ring 32 encircles the pole piece 20. The second magnetizing ring 32 is composed of steel. The second magnetizing ring 32 conducts the magnetism from the magnets 28 placed in front of it and creating a generally uniform magnetic field around the pole piece 20.

Figure 5:
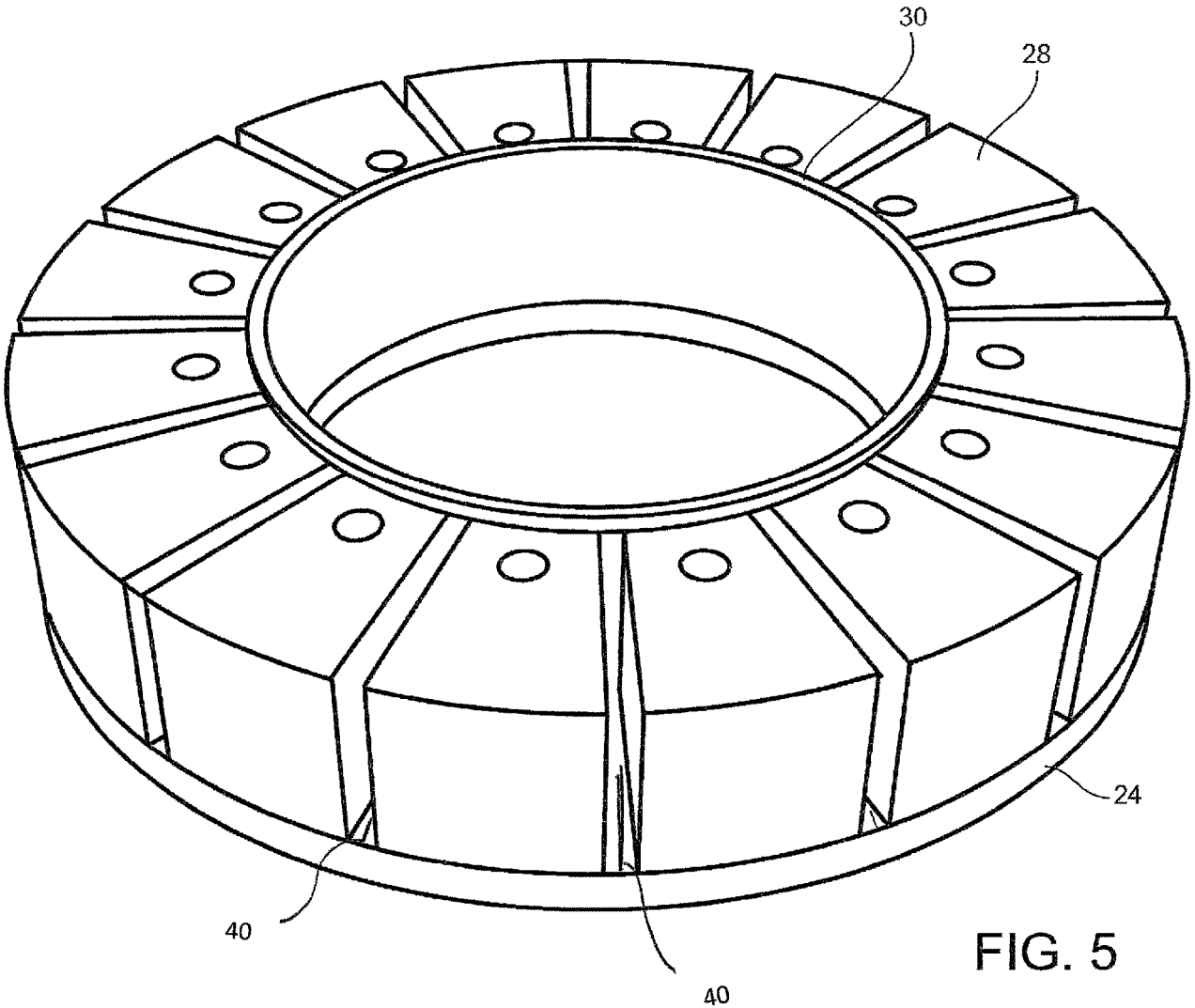
FIG. 5 is a perspective view of the shelf, magnets, and first magnetizing ring.
Figure 6:
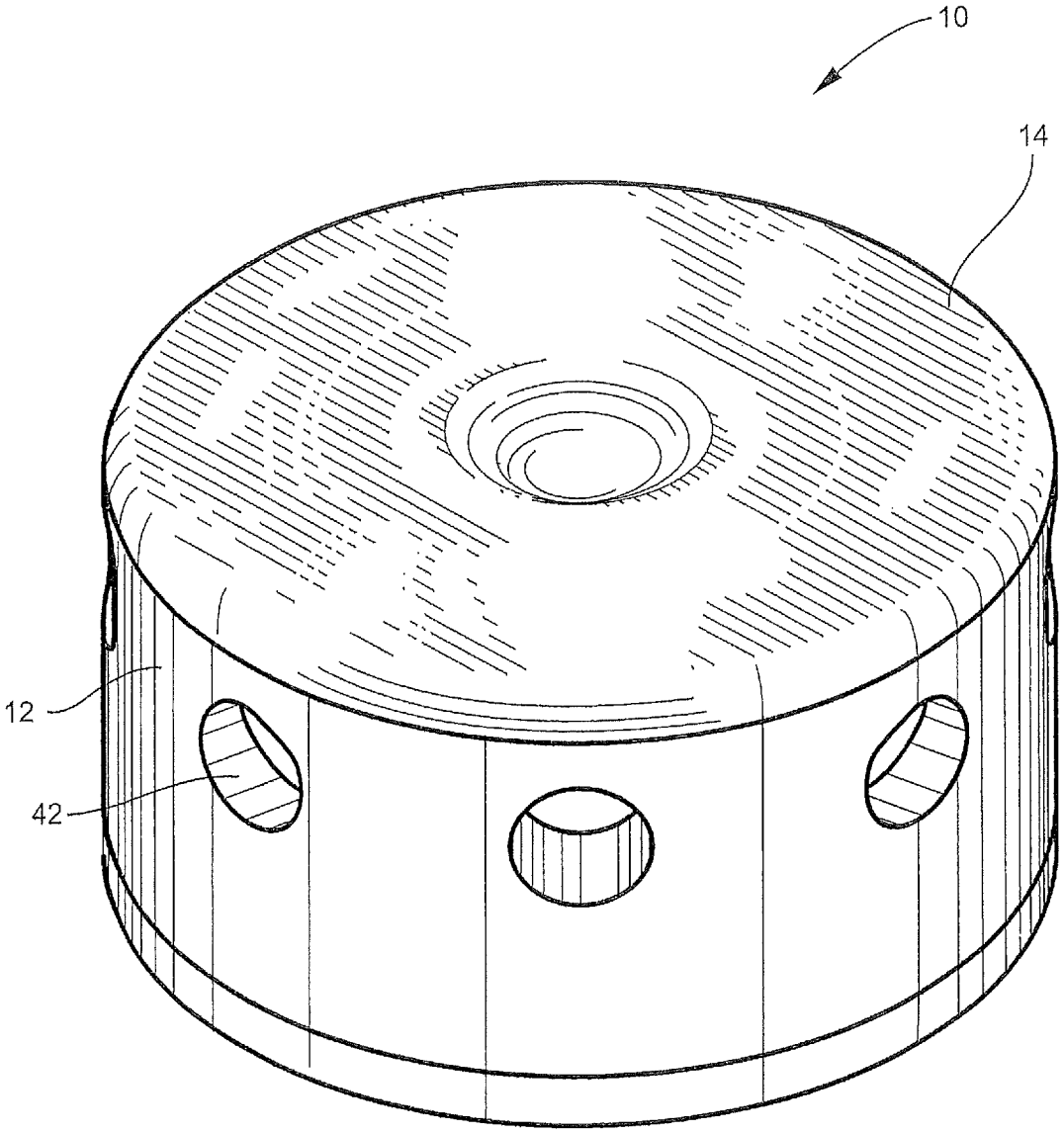
FIG. 6 is a perspective view of the bottom portion of the present invention.
Figure 7:
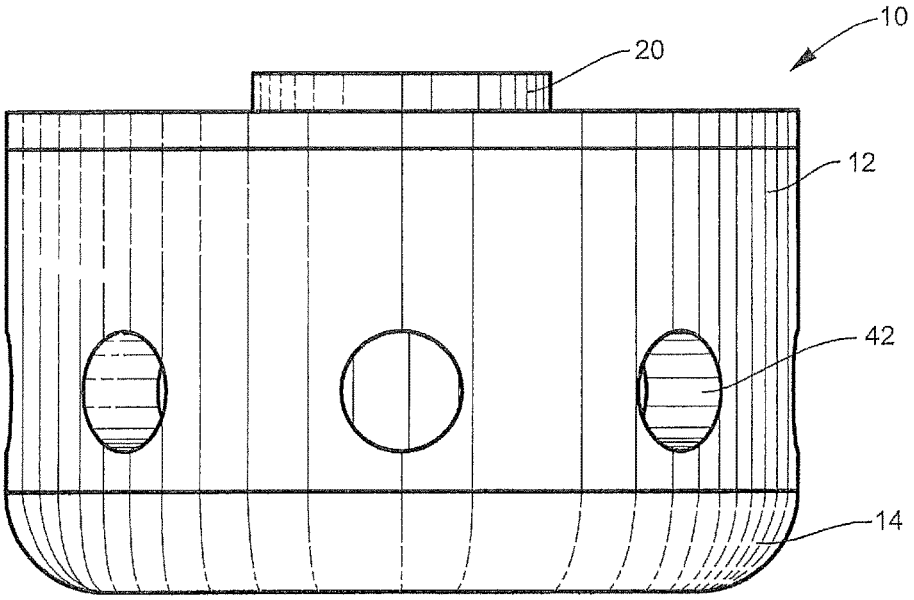
FIG. 7 is a side view of the present invention.
Figure 8:
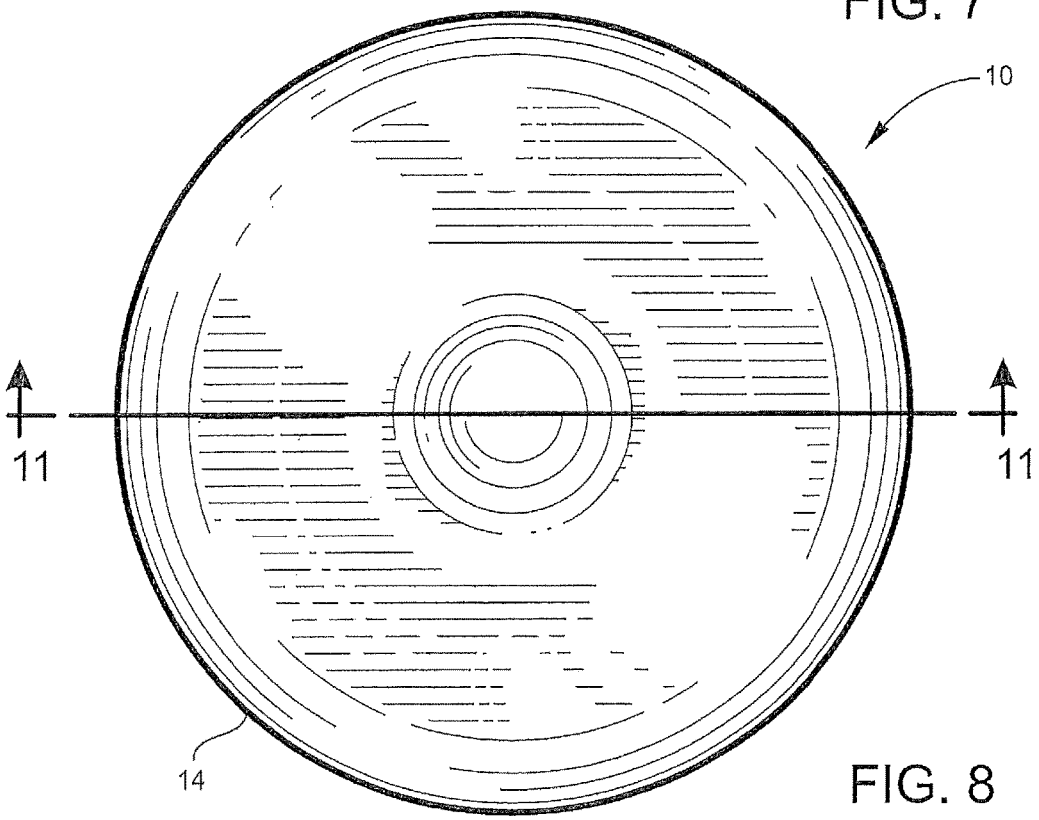
FIG. 8 is a bottom view of the present invention indicating a cross-sectional line 11.
Figure 9:
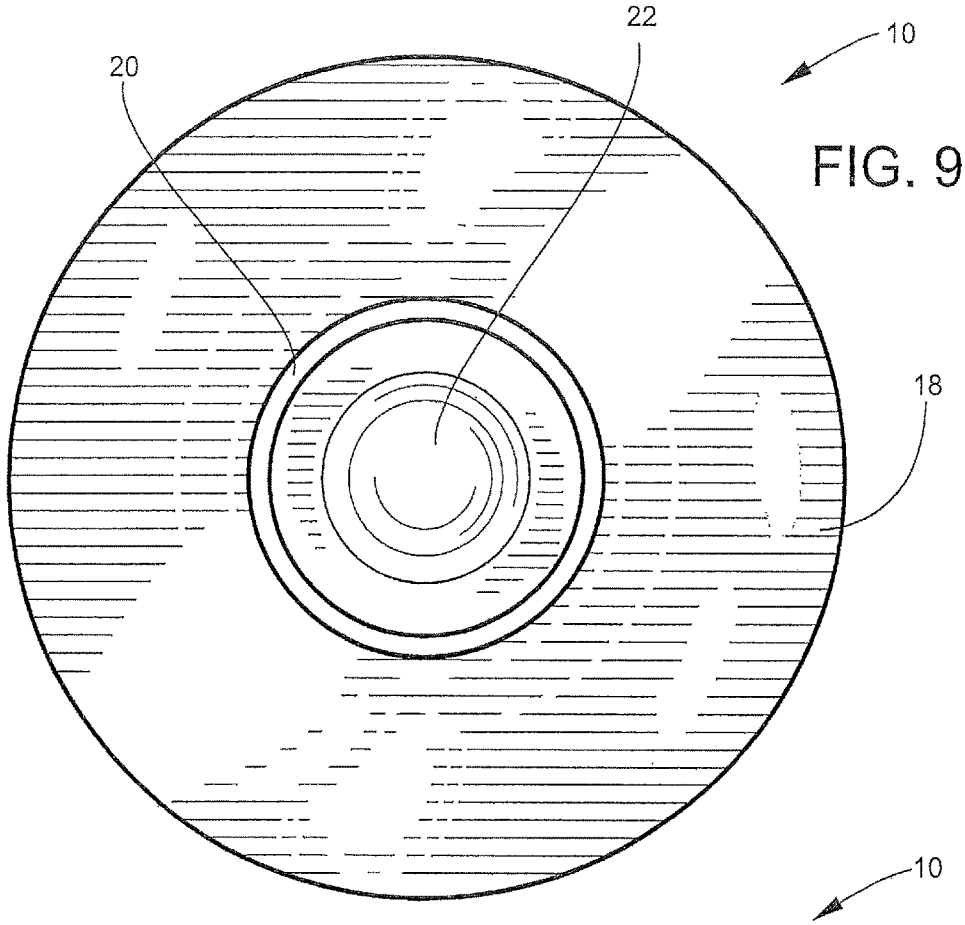
FIG. 9 is a top view of the present invention.
Figure 10:
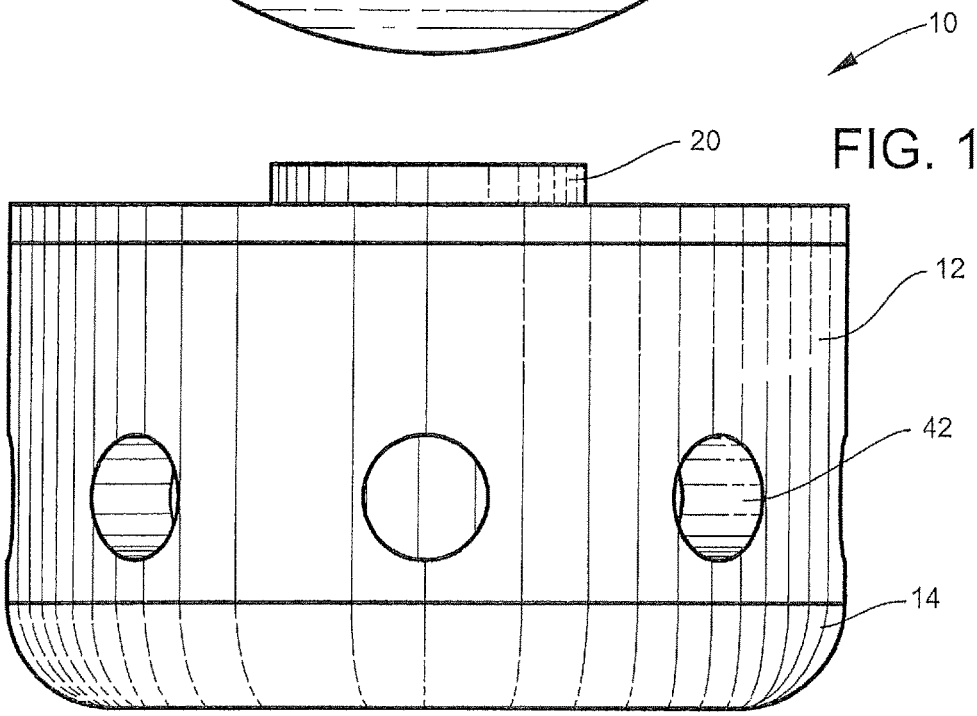
FIG. 10 is another side view of the present invention.

The first magnetizing ring 30 and optional second magnetizing ring 32 are meant to be defined as the rings that surround the air gap 26, or at least partially surround the air gap. As illustrated in FIGS. 3-5, the first magnetizing ring 30 and optional second magnetizing ring 32 have a smooth and concentric interior surface and exterior surface. It should be noted the interior surface and exterior surface do not have to have a smooth surface, but may have a surface that is angled, contains ridges, or contains at least two or a plurality of magnet surfaces. In this embodiment and by way of example, the exterior surface of the first magnetizing ring 30 may have at least two magnet surfaces or a plurality of magnet surfaces for receiving a magnet 28 on each magnet surface. In other words, the exterior surface of the first magnetizing ring 30 has magnet receiving surfaces that has a magnet 28 engaged thereto with each magnet surface spaced apart around the first magnetizing ring 30. Preferably, the magnet surface is positioned such that the magnet 28 is engaged thereto and is facing towards the air gap 26.

Preferably, the magnet 28 of the present invention is a neodymium magnet ("neo magnet'), which is a permanent magnet made from an allow of neodymium, iron, and boron to form a $Nd_2Fe_{14}B$ tetragonal crystalline structure. The neo magnet may be plated or coated prior to use in the present invention. Commonly, the neo magnet may be nickel plated.

Figure 12:
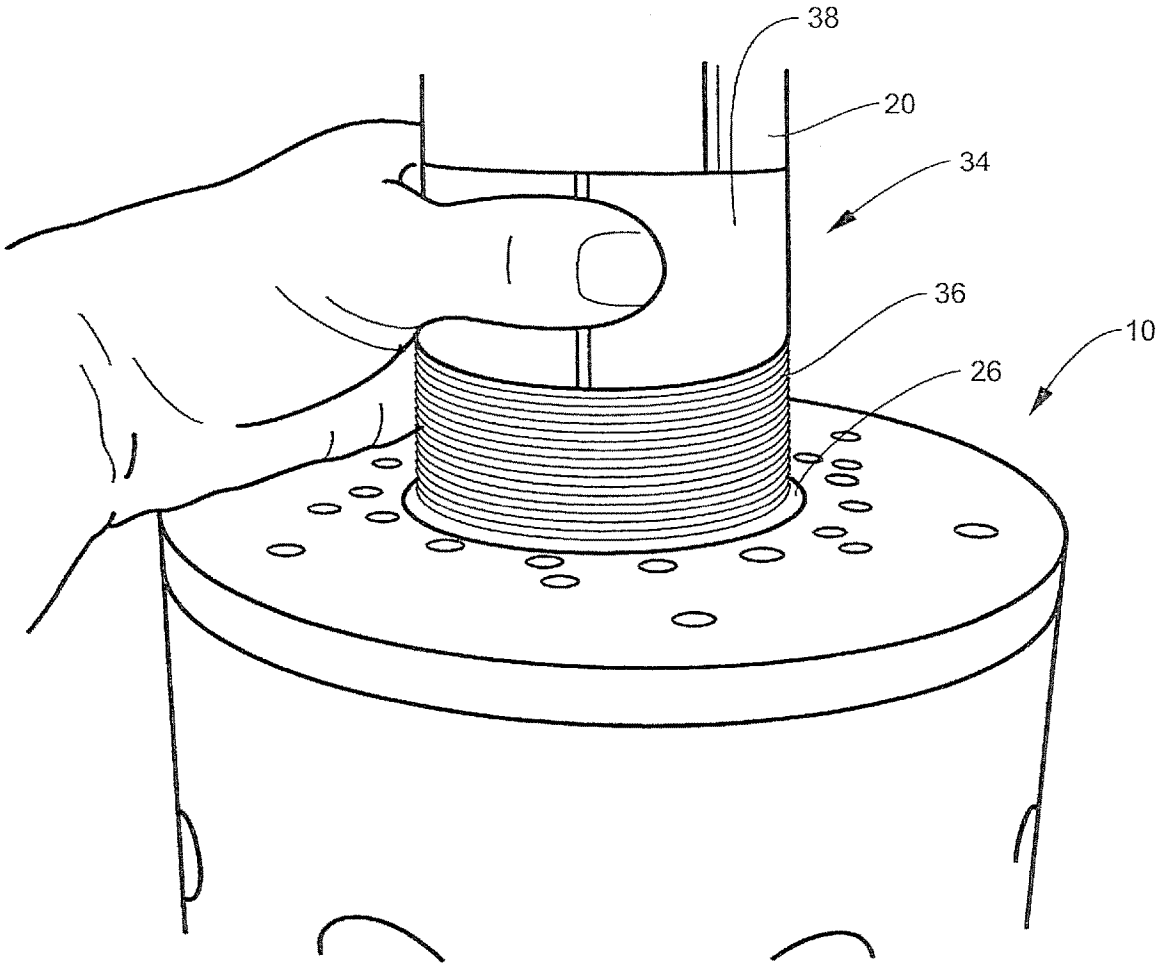
FIG. 12 is a view of an exemplary embodiment of the voice coil assembly.

A voice coil assembly 34 may be positioned around the pole piece 20 and within the air gap 26 between the first magnetizing ring 30 and magnet 28. As illustrated in FIG. 12, the voice coil assembly 34 preferably comprises a voice coil 36 and bobbin 38, which may be of any size and shape depending upon the desires of the user. The voice coil is preferably composed of copper.

As illustrated in FIGS. 3 and 4, the interior side of the top portion 18 of the housing 12 may be adjacent a side of the first magnetizing ring 30, magnet 28, and second magnetizing ring 32. The bottom portion 14, the side portion 16, and the top portion 18 are preferably composed of steel, but may be composed of another material as desired by the user.

Figure 13:
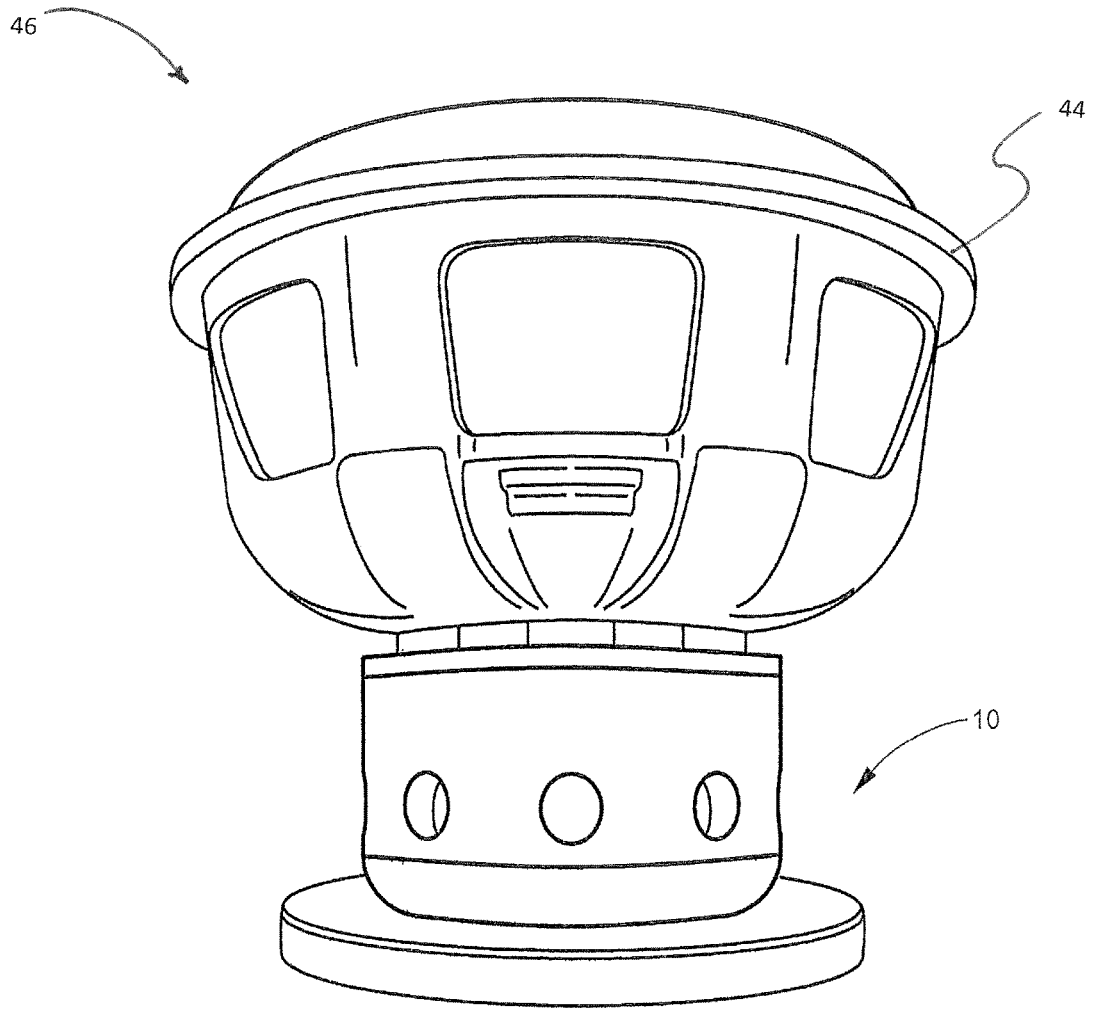
FIG. 13 is a side view of the diaphragm assembly and motor assembly.

The motor assembly 10 that is housed together with a diaphragm assembly 44 and collectively forming an audio speaker system 46, as illustrated in FIG. 13. The diaphragm assembly 44 preferably comprises a diaphragm, surround and spider. These components may have a number of different designs and configurations based upon the desires of the user. The diaphragm assembly 44 is engaged to the voice coil assembly 34 for transferring reciprocating motion during operation. In other words, the motor assembly 10 is configured to cause reciprocation axial movement of the diaphragm assembly through the voice coil assembly 34. As a result, the diaphragm assembly 44 generates sound waves through the pressure exerted on ambient air.

As illustrated in FIG. 5, the interior side of the magnet(s) 28 preferably have a radius of curvature the same as or similar to that of the pole piece 20. The exterior side of the magnet(s) 28 may have the same as or similar radius of curvature as the pole piece 20. In this embodiment, the magnet 28 is an equal distance away from the pole piece 20 at each location. Likewise, the first magnetizing ring 30 has a radius of curvature the same as or similar to the radius of curvature of the pole piece 20 or interior side of the magnet 28. The optional second magnetizing ring 32 may also have a radius of curvature the same as or similar to the radius of curvature of the pole piece 20 or the exterior side of the magnet(s) 28.

The top side of the shelf 24 may contain a groove 40 (or channel) for positioning the magnet(s) 28. The groove 40 is designed to retain a side of the magnet(s) 28 for allowing the positioning of the magnet(s) 28 during production of the motor assembly 10. The groove 40 would also act to support the magnet(s) 28 during operation of the motor assembly 10. The groove 40 consists of at least one raised side that extends upwardly from the top side of the shelf 24. The groove 40 consists at least two raised sides that expend upwardly from the top side of the shelf 24. The space between the two raised sides is slightly larger than the length of the magnet 28, allowing the magnet 28 to be positioned within the sides.

Figure 11:
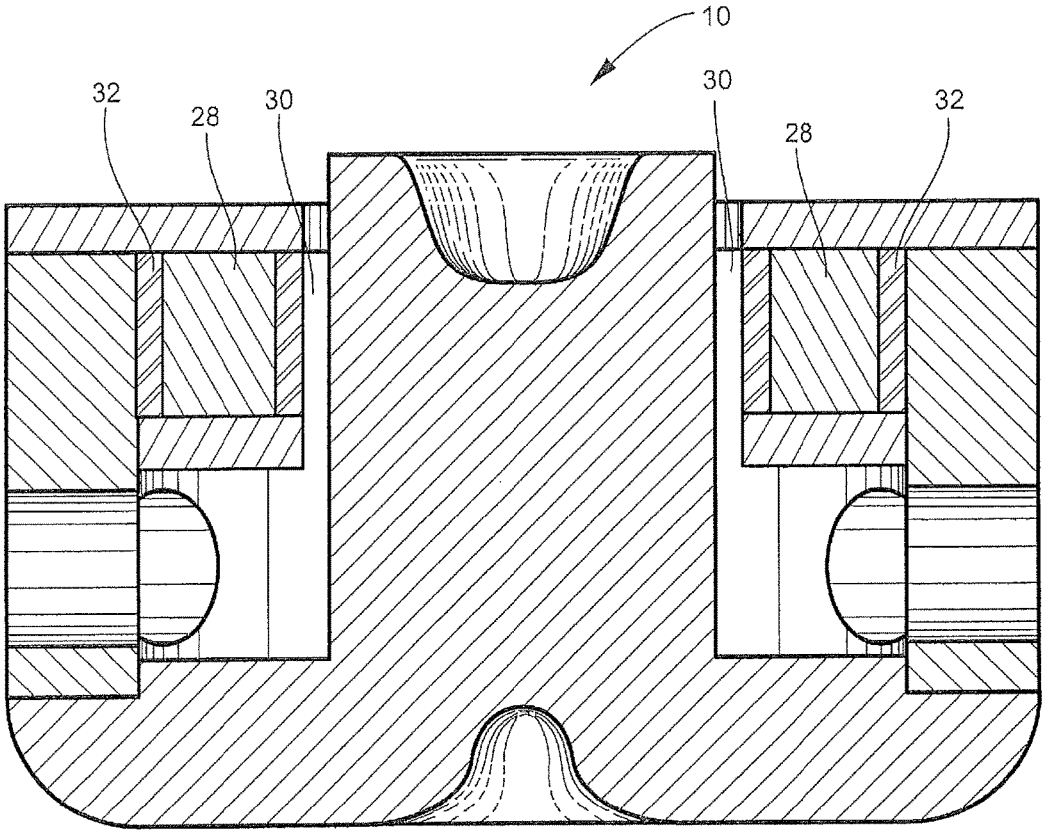
FIG. 11 is a cross-sectional view of another embodiment of the present invention.

As illustrated in FIG. 11, the magnet 28 may be engaged to either the first magnetizing ring 30 or the second magnetizing ring 32 without the need for a shelf 24.

At least one vent hole 42 may be formed within the side portion 16 for venting the inside of the housing 12. The at least one vent hole 42 extends from the interior side to the exterior side. The motor assembly 10 comprises a plurality of vent holes 42. In another alternative embodiment, the vent hole 42 may be positioned in the bottom portion 14.

The bottom portion 14 may be engaged to the side portion 16 by an attachment device 29, such as a bolt or screw. Preferably, the attachment device 29 is countersunk in the bottom portion 14. Likewise, the top portion 18 may be engaged to the side portion 16 by an attachment device 29, such as a bolt or screw. Preferably, the attachment device 29 is countersunk in the top portion 16.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A motor assembly, comprising:

a housing that comprises a bottom portion, a side portion with an exterior side and an interior side, and a top portion, the bottom portion extends to an outer edge and the side portion extends generally upward from the outer edge to an upper edge, the top portion is positioned on the upper edge;

a pole piece extending upwardly from the bottom portion;

a shelf extending outwardly from the interior side of the side portion and having a first end, a second end, a top side, and a bottom side, wherein the first end extends from the interior side of the side portion of the housing and an air gap is located between the pole piece and the second end of the shelf, the shelf extends circularly around the pole piece while being separated from the pole piece by the air gap;

a plurality of magnets are disposed on the shelf;

a first magnetizing ring disposed on an edge of the second end of the shelf having an interior surface, an exterior surface, and two opposed sides, the exterior surface faces the air gap and the interior surface is adjacent the plurality of magnets and the top portion is adjacent one side; and a plurality of vent holes formed within the side portion of the housing extending from the exterior side of the side portion to the interior side of the side portion.

2. The motor assembly according to claim 1, wherein the pole piece is generally circular and the plurality of magnets have a first side and a second side, whereby at least the first side has a radius of curvature, the same as a radius of curvature of the pole piece.

3. The motor assembly according to claim 1, further comprising a groove disposed on the top side of the shelf designed to retain a side of the magnet for allowing the positioning and support of the magnet, wherein the groove consists of two raised sides that extend upwardly from the top side of the shelf and the space between the two raised sides is slightly larger than the length of the magnet, allowing the magnet to be positioned within the sides.

4. The motor assembly according to claim 1, further comprising a second magnetizing ring disposed adjacent the back side of the magnet and having an interior surface, an exterior surface, and two opposed ends, the first magnetizing ring and the second magnetizing ring are placed on either side of each magnet with the interior surface of the second magnetizing ring adjacent the back side of the magnet and the exterior surface of the magnetizing ring adjacent the interior side of the side portion; the interior and exterior surface of the second magnetizing ring are concentric and having a radius of curvature the same as the pole piece.

5. The motor assembly according to claim 1, wherein the bottom portion is engaged to the side portion by an attachment device, and the top portion is engaged to the side portion by an attachment device.

6. The motor assembly according to claim 1, wherein the magnets are made from an allow of neodymium, iron, and boron to form a $Nd_2Fe_{14}B$ tetragonal crystalline structure that is nickel plated.

7. The motor assembly according to claim 1, further comprising a dimple within the bottom portion.

8. An audio speaker system assembly, comprising:

a housing that comprises a bottom portion, a side portion with an interior side and an exterior side, and a top portion, the bottom portion extends to an outer edge, the side portion extends generally upward from the outer edge, and the top portion is positioned on an upper edge, the bottom portion is engaged to the side portion by an attachment device, and the top portion is engaged to the side portion by another attachment device;

a pole piece extending upwardly from the bottom portion having a radius of curvature;

a shelf extending outwardly from the interior side of the side portion, wherein the first end extends from the interior side of the side portion of the housing and an air gap is located between the pole piece and the second end of the shelf, the shelf extends circularly around the pole piece, while being separated from the pole piece by the air gap;

a plurality of magnets spaced-apart from each other and disposed on the shelf;

a circular first magnetizing ring disposed on an edge of the second end of the shelf and adjacent the plurality of magnets, an exterior surface of the first magnetizing ring faces the air gap and an interior surface of the first magnetizing ring is adjacent the plurality of magnets;

a second magnetizing ring disposed adjacent a back side of the plurality of magnets and having an interior surface, an exterior surface, and two opposed ends, the second magnetizing ring adjacent the back side of the plurality of magnets and the exterior surface of the second magnetizing ring adjacent the interior side of the side portion; the interior and exterior surface of the second magnetizing ring are concentric and having a radius of curvature the same as the pole piece, and;

a plurality of vent holes formed within the side portion of the housing extending from the exterior side of the side portion to the interior side of the side portion.

9. The audio speaker system assembly according to claim 8, wherein each of the plurality of magnets is spaced an equal distance apart from each other around the periphery of the pole piece.

10. The audio speaker system assembly according to claim 8, further comprising a notch on an end of the pole piece.

11. The audio speaker system assembly according to claim 8, further comprising a voice coil and bobbin that partially encircles the pole piece.

12. The audio speaker system assembly according to claim 8, wherein the first magnetizing ring is composed of aluminum.

13. The audio speaker system assembly according to claim 8, the magnets are made from an allow of neodymium, iron, and boron to form a $Nd_2Fe_{14}B$ tetragonal crystalline structure that is nickel plated.

14. An audio speaker system assembly, comprising:

a housing that comprises a bottom portion, a side portion with an interior surface and an exterior surface, and a top portion, the bottom portion extends to an outer edge, the side portion extends generally upward from the outer edge to an upper edge, and the top portion is positioned on the upper edge the bottom portion is engaged to the side portion by an attachment device, and the top portion is engaged to the side portion by another attachment device;

a pole piece extending upwardly from the bottom portion;

a shelf extending outwardly from the interior side of the side portion, wherein the first end extends from the interior side of the side portion of the housing and an air gap is located between the pole piece and the second end of the shelf the shelf extends circularly around the pole piece, while being separated from the pole piece by the air gap;

a plurality of magnets spaced-apart from each other and disposed on the shelf;

a groove disposed on the top side of the shelf designed to retain a side of the plurality of magnets for allowing the positioning and support of the plurality of magnets wherein the groove consists of two raised sides that extend upwardly from the top side of the shelf and the space between the two raised sides is slightly larger than the length of the plurality of magnets allowing the plurality of magnets to be positioned within the sides;

a first magnetizing ring disposed on an edge of the second end of the shelf and adjacent the plurality of magnets, an exterior surface of the first magnetizing ring faces the air gap and an interior surface of the first magnetizing ring is adjacent the plurality of magnets;

wherein the plurality of magnets are engaged to the first magnetizing ring;

a second magnetizing ring disposed adjacent the back side of the plurality of magnets and having an interior surface, an exterior surface, and two opposed ends, the second magnetizing ring adjacent the back side of the plurality of magnets and the exterior surface of the second magnetizing ring adjacent the interior side of the side portion; the interior and exterior surface of the second magnetizing ring are concentric and having a radius of curvature the same as the pole piece;

a diaphragm assembly engaged to the housing; and a plurality of vent holes formed within the side portion of the housing extending from the exterior side surface of the side portion to the interior surface of the side portion.

15. The audio speaker system assembly according to claim 14, further comprising a notch on an end of the pole piece.

16. The audio speaker system assembly according to claim 14, wherein the magnets are made from an allow of neodymium, iron, and boron to form a $Nd_2Fe_{14}B$ tetragonal crystalline structure that is nickel plated.

17. The audio speaker system assembly according to claim 14, wherein the top portion is adjacent a side of the first magnetizing ring and the magnets.

18. The audio speaker system assembly according to claim 14, wherein the attachment device is a bolt.

19. The audio speaker system assembly according to claim 14, wherein the attachment device is a screw and countersunk within the top portion.

* * * * *